US011298807B2

(12) United States Patent
Poonawalla et al.

(10) Patent No.: US 11,298,807 B2
(45) Date of Patent: Apr. 12, 2022

(54) RATCHETING BOX TORQUE WRENCH

(71) Applicant: HUBBELL INCORPORATED, Shelton, CT (US)

(72) Inventors: Zaheer Firoz Poonawalla, Clanton, AL (US); Seydou Diop, Birmingham, AL (US); Adrian Beau Candelaria, Alabaster, AL (US)

(73) Assignee: Hubbell Incorporated, Shelton, CT (US)

( * ) Notice: Subject to any disclaimer, the term of this patent is extended or adjusted under 35 U.S.C. 154(b) by 257 days.

(21) Appl. No.: 15/799,653

(22) Filed: Oct. 31, 2017

(65) Prior Publication Data

US 2019/0126449 A1 May 2, 2019

(51) Int. Cl.

| | |
|---|---|
| ***B25B 23/142*** | (2006.01) |
| ***B25G 1/12*** | (2006.01) |
| ***B25B 13/46*** | (2006.01) |
| ***B25B 13/04*** | (2006.01) |

(52) U.S. Cl.

CPC ..... *B25B 23/1427* (2013.01); *B25B 13/04* (2013.01); *B25B 13/462* (2013.01); *B25G 1/125* (2013.01)

(58) Field of Classification Search

CPC ... B25B 23/1427; B25B 13/462; B25B 13/04; B25G 1/125

USPC ..... 81/59.1, 474–480

See application file for complete search history.

(56) References Cited

U.S. PATENT DOCUMENTS

| | | | | |
|---|---|---|---|---|
| 1,860,871 | A * | 5/1932 | Pouliot | B25B 13/463 81/480 |
| 2,447,109 | A * | 8/1948 | Billeter | B25B 23/1427 73/862.26 |
| 2,466,372 | A * | 4/1949 | Byrd | B25B 23/141 81/476 |
| 2,686,446 | A | 8/1954 | Livermont | |
| 2,789,454 | A | 4/1957 | Woods | |
| 2,797,564 | A * | 7/1957 | Bonneau | B25B 23/1427 464/38 |
| 3,236,127 | A | 2/1966 | Knudsen et al. | |
| 4,403,531 | A * | 9/1983 | Bailey | B25B 23/1427 81/483 |
| 4,744,271 | A * | 5/1988 | Collins | B25B 13/462 81/57.39 |
| 5,337,638 | A | 8/1994 | Coss | |
| 5,713,251 | A | 2/1998 | Zurbuchen | |
| 6,134,990 | A | 10/2000 | Ling | |
| 6,148,695 | A | 11/2000 | Hu | |
| 6,276,243 | B1 | 8/2001 | Jenkins | |

(Continued)

FOREIGN PATENT DOCUMENTS

| | | |
|---|---|---|
| EP | 1731114 | 12/2006 |

OTHER PUBLICATIONS

International Search Report dated Jan. 18, 2019 from corresponding PCT International Patent Application No. PCT/US2018/057536, 3 pages.

(Continued)

*Primary Examiner* — Monica S Carter
*Assistant Examiner* — Marcel T Dion
(74) *Attorney, Agent, or Firm* — Ohlandt, Greeley, Ruggiero & Perle, LLP

(57) ABSTRACT

A ratcheting box torque wrench is provided. The wrench includes a head and a handle connected to the head. The head has a slipping torque limiter that applies torque to a fastener in a first direction (T) up to a torque limit before slipping in the first direction (T) and ratchets in a second direction (R).

22 Claims, 10 Drawing Sheets

(56) References Cited

U.S. PATENT DOCUMENTS 6,662,693 B2 * 12/2003 Hu ..... B25B 23/141 464/35
6,792,830 B2 * 9/2004 DeKeuster ..... B25B 13/463 192/43.1
6,832,533 B1 * 12/2004 Huang ..... B25B 23/1427 81/467
6,990,877 B1 * 1/2006 Wu ..... B25B 13/465 81/467
7,270,036 B1 * 9/2007 Chen ..... B25B 13/463 81/467
7,451,674 B2 * 11/2008 Edgar ..... B25B 23/1427 73/862.21
2001/0035079 A1 * 11/2001 Kesinger ..... B25B 23/141 81/437
2003/0159552 A1 * 8/2003 Hsieh ..... B25B 23/1427 81/478
2003/0205115 A1 * 11/2003 Hu ..... B25B 23/1427 81/475
2006/0027049 A1 2/2006 Arnold
2011/0154961 A1 * 6/2011 Kan ..... B25B 13/465 81/478
2012/0011971 A1 * 1/2012 Ogata ..... B25B 23/1427 81/478
2012/0279365 A1 11/2012 Cummings
2014/0373691 A1 * 12/2014 Lin ..... B25B 13/06 81/480
2015/0239110 A1 * 8/2015 Hsieh ..... B25B 15/04 81/480
2016/0271787 A1 9/2016 Sakmar

OTHER PUBLICATIONS

Written Opinion dated Jan. 18, 2019 from corresponding PCT International Patent Application No. PCT/US2018/057536, 5 pages.

* cited by examiner

RATCHETING BOX TORQUE WRENCH

BACKGROUND

1. Field of the Invention

The present disclosure is related to ratcheting box wrenches. More particularly, the present disclosure is related to ratcheting box torque wrenches.

2. Description of Related Art

Wrenches having an elongated handle together with either an open end or a closed end are well known. The open wrenches allow the user to easily adjust engagement with a fastener through the open end of the wrench—moving the wrench in a direction perpendicular to the fastener. Conversely, closed end wrenches—often referred to as box-end wrenches, box wrenches, or ring-spanner wrenches—must be lifted off the fastener, namely moving the wrench in a direction parallel to the fastener. In some instances, box wrenches include ratcheting functionality that improves the engagement with the fastener.

While some wrenches are provided with a single wrench end, wrenches are also known to be double ended—where both ends can be open, both ends can be closed, or one end open and the other closed (e.g., combination wrenches).

In some instances, the wrench end—regardless of type (e.g., box, open, combination, ratcheting or non-ratcheting)—can be secured to remaining portion of the handle with a bend (e.g., offset wrench) or a hinged connection (e.g., flex wrench).

It is often desired to measure the amount of torque applied to a fastener so as to ensure proper loading and/or prevent overloading of the fastener. Thus, many fastener tools include a torque measuring capability—and are referred to as torque wrenches.

It has been determined by the present disclosure that there is a need for ratcheting box torque wrenches.

SUMMARY

A ratcheting box torque wrench is provided. The wrench includes a head and a handle connected to the head. The head has a slipping torque limiter that applies torque to a fastener in a first direction (T) up to a torque limit before slipping in the first direction (T) and ratchets in a second direction (R).

In some embodiments either alone or together with any one or more of the aforementioned and/or after-mentioned embodiments, the head is fixed to the handle or is removably attached to the handle.

In some embodiments either alone or together with any one or more of the aforementioned and/or after-mentioned embodiments, the head and/or handle lack any bend and/or hinge.

In some embodiments either alone or together with any one or more of the aforementioned and/or after-mentioned embodiments, the handle is an electrically non-conductive handle.

In some embodiments either alone or together with any one or more of the aforementioned and/or after-mentioned embodiments, the slipping torque limiter includes a gear wheel, a roller, and a coil spring. The gear wheel has an inner surface and an outer surface. The inner surface applies torque to the fastener. The outer surface has a plurality of teeth having a space between adjacent teeth. The spring biasing the roller into the space with a holding force (F).

In some embodiments either alone or together with any one or more of the aforementioned and/or after-mentioned embodiments, the inner surface is configured to directly apply the torque to an outer surface of the fastener.

In some embodiments either alone or together with any one or more of the aforementioned and/or after-mentioned embodiments, the inner surface is configured to directly apply the torque to an intermediate member that transmits the torque to an inner or outer surface of the fastener.

In some embodiments either alone or together with any one or more of the aforementioned and/or after-mentioned embodiments, each tooth of the plurality of teeth has a leading edge and a trailing edge. The leading edge faces the first direction and the trailing edge faces the second direction. The leading edge has a stepped profile and the trailing edge has an un-stepped profile.

In some embodiments either alone or together with any one or more of the aforementioned and/or after-mentioned embodiments, the spring, when torque applied in the first direction (T) is below the holding force (F), maintains the roller in the space allowing the inner surface of the gear wheel to transmit torque.

In some embodiments either alone or together with any one or more of the aforementioned and/or after-mentioned embodiments, the spring, when torque applied in the first direction (T) is above the holding force (F), compresses so that the roller slips from the space over the stepped profile allowing the gear wheel to rotate without transmitting torque.

In some embodiments either alone or together with any one or more of the aforementioned and/or after-mentioned embodiments, the spring, when torque is applied in the second direction (R), compresses as the roller slips from the space over the un-stepped profile allowing the gear wheel to ratchet.

In some embodiments either alone or together with any one or more of the aforementioned and/or after-mentioned embodiments, the slipping torque limiter has a single, predetermined or factory set torque limit.

In some embodiments either alone or together with any one or more of the aforementioned and/or after-mentioned embodiments, the slipping torque limiter has a torque adjusting assembly that allows adjustment of the torque limit.

In some embodiments either alone or together with any one or more of the aforementioned and/or after-mentioned embodiments, the slipping torque limiter has a torque adjusting assembly that allows adjustment of the torque limit.

In some embodiments either alone or together with any one or more of the aforementioned and/or after-mentioned embodiments, the torque adjusting assembly adjusts the holding force (F) that the spring biases the roller into the space.

In some embodiments either alone or together with any one or more of the aforementioned and/or after-mentioned embodiments, the torque adjusting assembly includes a worm gear threadably received over a spring cartridge. The spring is supported in the spring cartridge at an end opposite the roller. Thus, rotation of the worm gear is translated into linear movement along a longitudinal axis (L) towards the roller so as to compress the spring resulting in an increase in the holding force (F) or away from the roller so as to elongate the spring resulting in a decrease in the holding force (F).

In some embodiments either alone or together with any one or more of the aforementioned and/or after-mentioned embodiments, the torque adjusting assembly includes an indicator depending from the spring cartridge. The movement of the spring cartridge provides corresponding movement of the indicator to one or more markings corresponding to the torque limit.

In some embodiments either alone or together with any one or more of the aforementioned and/or after-mentioned embodiments, the torque adjusting assembly adjusts the holding force (F) that the spring biases the roller into the space by rotation of the head and the handle with respect to one another about a longitudinal axis (L).

In some embodiments either alone or together with any one or more of the aforementioned and/or after-mentioned embodiments, the torque adjusting assembly includes a drive rod and a drive plate. The drive plate supports an end of the spring opposite from the roller. The drive plate is threadably received on an outer surface of the drive rod so that rotation of the head and the handle with respect to one another threadably moves the drive plate along the longitudinal axis (L) towards the roller so as to compress the spring resulting in an increase in the holding force (F) or away from the roller so as to elongate the spring resulting in a decrease in the holding force (F).

In some embodiments either alone or together with any one or more of the aforementioned and/or after-mentioned embodiments, the torque adjusting assembly includes a fixed portion and a rotational portion. The fixed portion is fixedly secured in the handle. The rotational portion is secured to the head and is secured to the fixed portion so that the rotational portion rotates about the longitudinal axis (L). The drive rod is secured to fixed portion.

In some embodiments either alone or together with any one or more of the aforementioned and/or after-mentioned embodiments, the torque adjusting assembly includes an indicator, where movement of the spring provides corresponding movement of the indicator to one or more markings corresponding to the torque limit.

The above-described and other features and advantages of the present disclosure will be appreciated and understood by those skilled in the art from the following detailed description, drawings, and appended claims.

DETAILED DESCRIPTION

Figure 1:
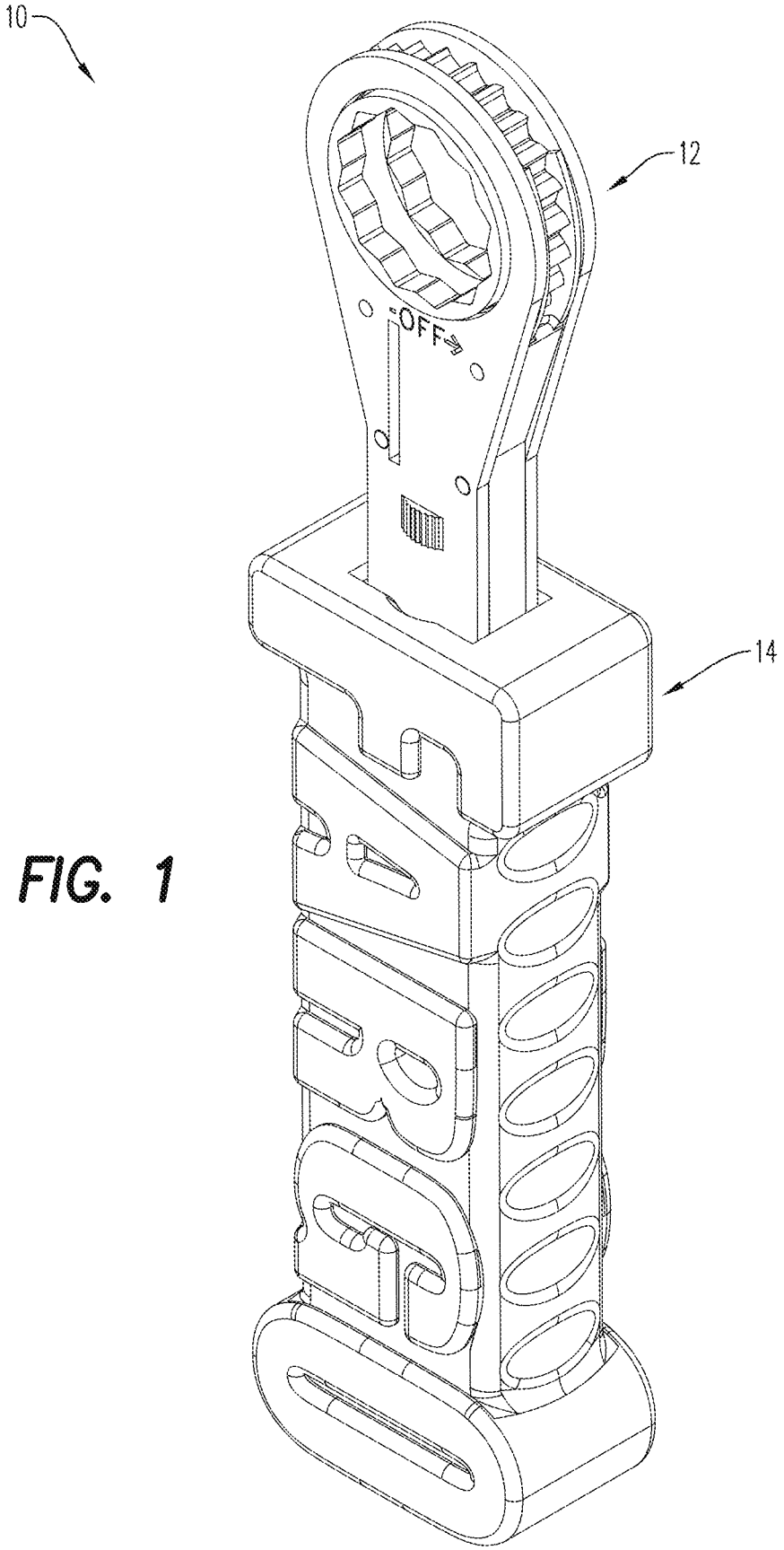
FIG. 1 is a perspective view of an exemplary embodiment of a ratcheting box torque wrench according to the present disclosure.
Figure 2:
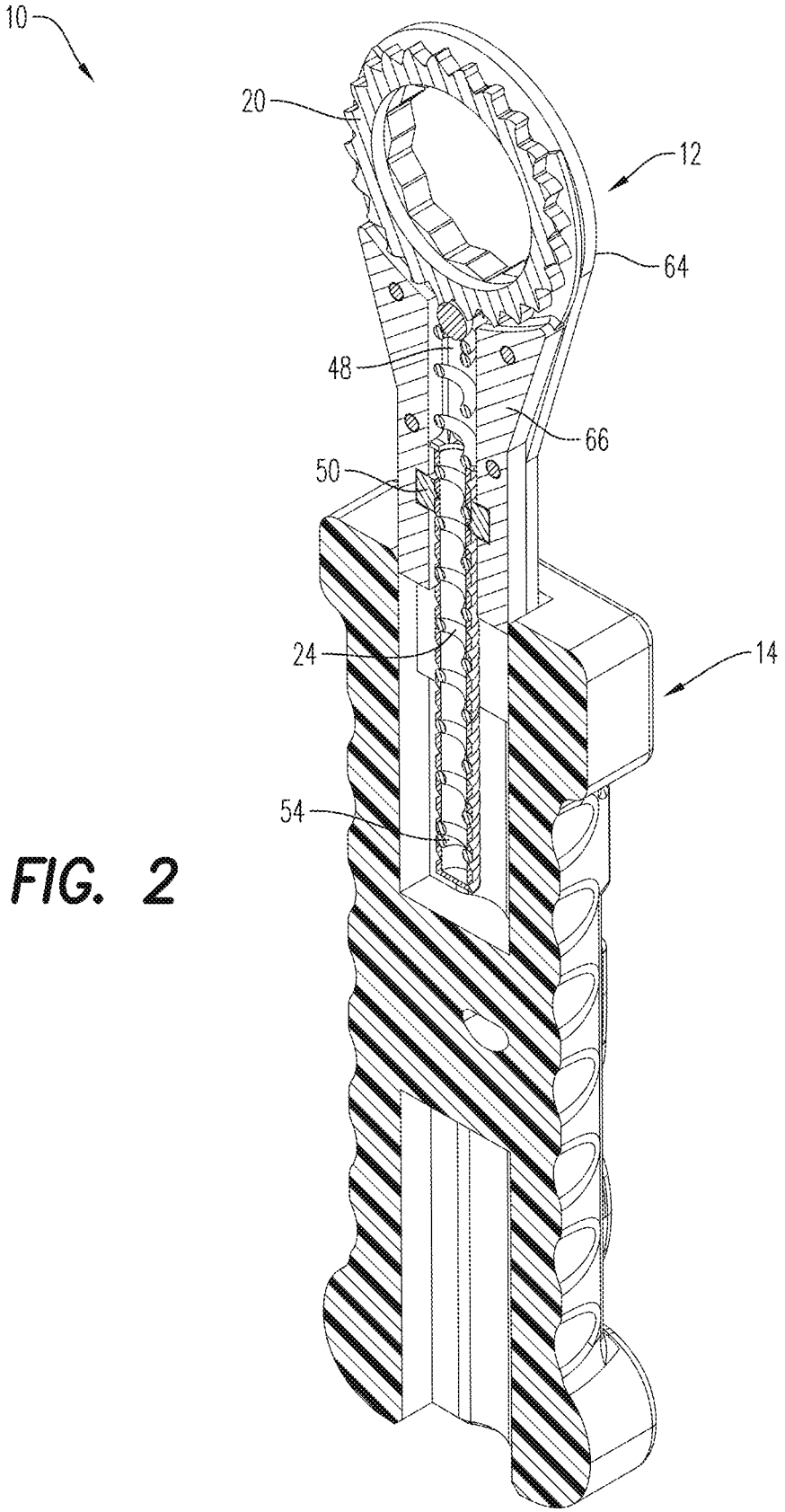
FIG. 2 is a sectional view of the wrench of FIG. 1.

Referring to the drawings and in particular to FIG. 1, an exemplary embodiment of a ratcheting box torque wrench according to the present disclosure is shown and is generally referred to by reference numeral 10.

Wrench 10 includes a head 12 and a handle 14. Head 12 is a ratcheting box wrench that also functions as a torque limiting slip wrench. Head 12 can be a separate member that is fixed to handle 14 or can be a separate member that is removably attached to the handle.

Additionally, wrench 10 is shown having head 12 and/or handle 14 as solid, straight members, namely lacking any bend and/or hinge. Of course, it is contemplated by the present disclosure for head 12 and/or handle 14 to include one or more hinges (not shown) and/or one or more bends (also not shown).

In the illustrated embodiment, handle 14 is shown as an electrically non-conductive handle as disclosed in Applicant's own U.S. application Ser. No. 14/663,131, the contents of which are incorporated by reference herein.

Additionally, although wrench 10 is shown as a single sided wrench, namely only having one head 12, it is contemplated by the present disclosure for the wrenches of the present disclosure to find equal use with two wrenches positioned in handle 14 (i.e., double ended wrench). In the double ended embodiments, both ends of wrench 10 can include head 12 having the torque limiting structures disclosed herein. Alternately, the double ended embodiments can include one end of wrench 10 having head 12 with the torque limiting structures disclosed herein, while the opposite end has a different type of wrench.

Head 12 is described in more detail with simultaneous reference to FIGS. 2-5. Head 12 includes a gear wheel 20, a roller 22, and a coil spring 24 that together form a slipping torque limiter 26. Slipping torque limiter 26 applies torque to a fastener (not shown) in a first direction (T) up to a limit before slipping in the first direction and ratchets or freely slips in a second direction (R). In this manner, head 12 allows the user to apply torque via wrench 10 to the fastener in order to ensure proper loading and prevent overloading of the fastener.

In some embodiments, head 12 can be configured to have a single, predetermined or factory set torque limit set to a predefined torque limit. In other embodiments, head 12 can have an adjustable torque limit. In these adjustable embodiments, head 12 can include a torque adjusting assembly 28, which allows the user to set an amount of torque applied by wrench 10 in the first direction (T) before slipping.

Gear wheel 20 includes an inner surface 32 and an outer surface 34. Inner surface 32 is configured to apply torque to the fastener in a known manner. Outer surface 34 includes a plurality of teeth 36. Spring 24 biases roller 22 against outer surface 34 of gear wheel 20 and into a space 38 between two of the teeth 36. Each tooth 36 has a leading edge 40 and a trailing edge 42. Leading edge 40 faces the direction of torque application, namely first direction (T), while trailing edge 42 faces the direction of ratcheting, namely second direction (R).

Leading edge 40 includes a stepped profile 44, which is believed to assist in capturing roller 22 in space 38 during application of torque in first direction (T). Stepped profile 44 is shown as a change in slope of leading edge 40. Conversely, trailing edge 42 has an un-stepped profile 46, which is believed to assist in allowing roller 22 to ratchet from space 38 during movement in second direction (R). Simply stated, leading edge 40 has stepped profile 44 that provides a profile resulting in increased force on roller 22 as compared to un-stepped profile 46 of trailing edge 42.

Simply stated, the pattern and shape of teeth 36 on outer surface 34 allows for ratcheting. Here, the direction of the curve of leading edge 40 (e.g., stepped profile 44) of teeth 36 dictates the "on/off" direction of ratcheting. The space 38 of the teeth 36 allows the roller 22 to sit in gear wheel 20 to allow the application of torque, but allows the roller to slip and not transmit torque above the established torque value.

Accordingly, roller 22 is biased into space 38—namely against edges 40, 42 of a pair of adjected teeth 36 by spring 24 with a holding force (F). When torque applied in the first direction (T) is below the holding force (F), slipping torque limiter 26 transmits the torque through roller 22 and gear wheel 20 to the fastener.

However, when torque applied in the first direction (T) is above the holding force (F), slipping torque limiter 26 does not transmit the torque through roller 22 and gear wheel 20 to the fastener. Rather, spring 24 compresses so that roller 22 slips over stepped profile 44, which allows gear wheel 20 rotate. Here, roller 22 will continue to slip from space 38 to space 38 as gear wheel 20 rotates until the applied torque is reduced below the limit necessary to overcome the holding force (F). As a result, wrench 10 is configured—via slipping torque limiter 26—to not over tighten the fastener by continuing to apply torque beyond a limit to which the wrench is set.

When torque is applied in the second direction (R), slipping torque limiter 26 allows gear wheel 20 to ratchet or freely slip. Here, spring 24 compresses as roller 22 slips over profile 46, which allows gear wheel 20 ratchet or freely slip. As a result, wrench 10 is configured—via slipping torque limiter 26—to also function as a ratcheting box wrench.

Roller 22 is illustrated as a spherical member held in a spring end 48 of spring 24. Preferably, roller 22 is formed of a material of equivalent or harder material than gear wheel 20. For example, it is contemplated by the present disclosure for roller 22 to be formed of AISI 4140 alloy steel, which is a chromium, molybdenum, manganese containing low alloy steel.

Figure 3:
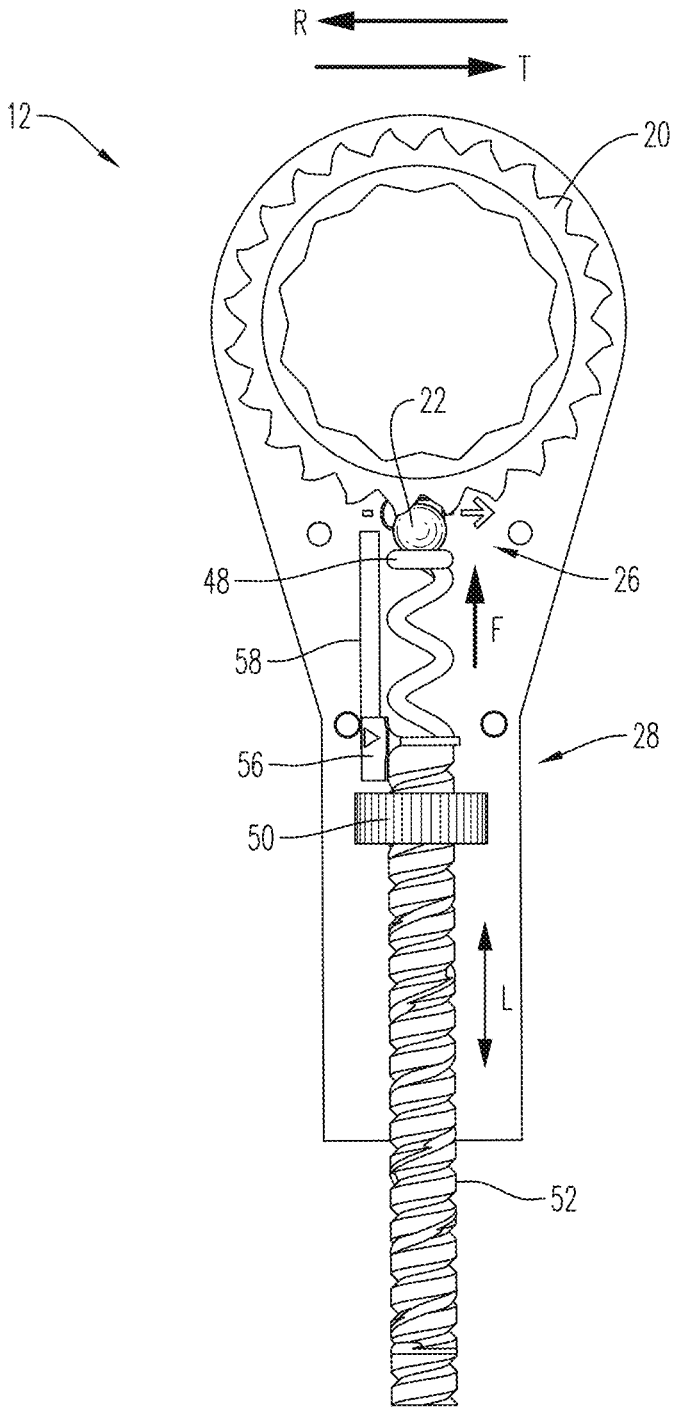
FIG. 3 is a sectional view of a wrench head according to the present disclosure usable in the wrench of FIG. 1.
Figure 4:
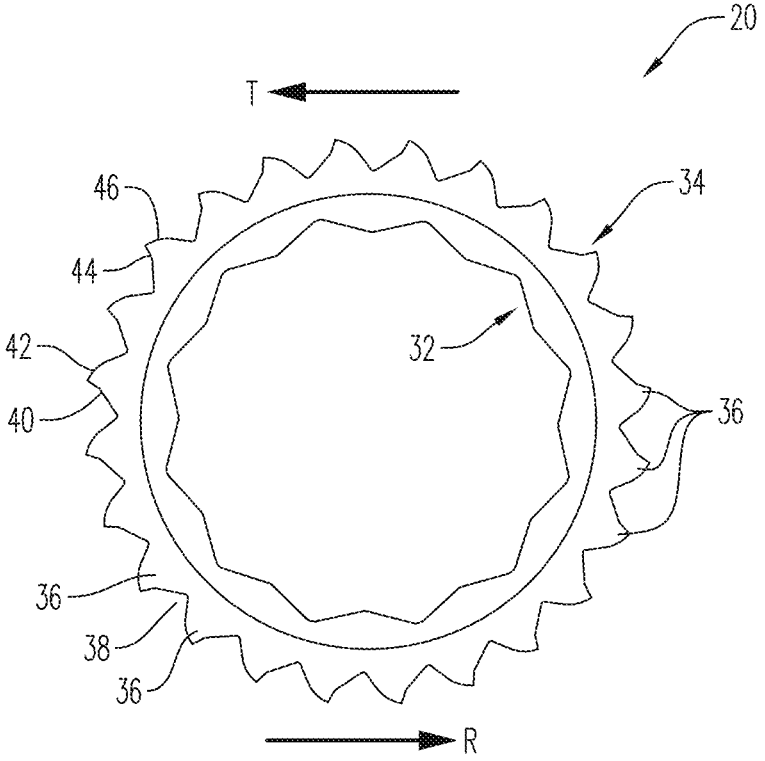
FIG. 4 is a front view of a gear wheel according to the present disclosure of usable in the wrench of FIG. 1.

Torque adjusting assembly 28, which allows for adjustment of the amount of torque wrench 10 applies to the fastener, is described in more detail with reference to FIG. 3. Assembly 28 includes a worm gear 50 threadably received over a spring cartridge 52. In this manner, rotation of worm gear 50 is translated into linear movement along longitudinal axis (L) of spring cartridge 52 towards or away from roller 22. Spring cartridge 52 supports a spring end 54 of spring 24 opposite from end 48 and roller 22.

Rotation of worm gear 50 that results in movement of cartridge 52 along axis (L) towards roller 22 compresses spring 24 between the roller and the cartridge, resulting in an increase in holding force (F)—and a corresponding increase in the torque that wrench 10 applies to the fastener in first direction (T). Conversely, rotation of worm gear 50 that results in movement of along axis (L) cartridge 52 away from roller 22 allows spring 24 to decompress or elongate, resulting in a decrease in holding force (F)—and a corresponding decrease in the torque that wrench 10 applies to the fastener in first direction (T).

In some embodiments, assembly 28 can include an indicator 56 depending from cartridge 52 so that movement of the cartridge along axis (L) provides corresponding movement of the indicator. Assembly 28 includes a window 58 in one or more portions of head 12, which allow indicator 56 to be visible to the user. Here, head 12 can include one or more markings 60 of the position of indicator 56 seen through window 58, where the markings correspond to the torque limit of slipping torque limiter 26.

Figure 5:
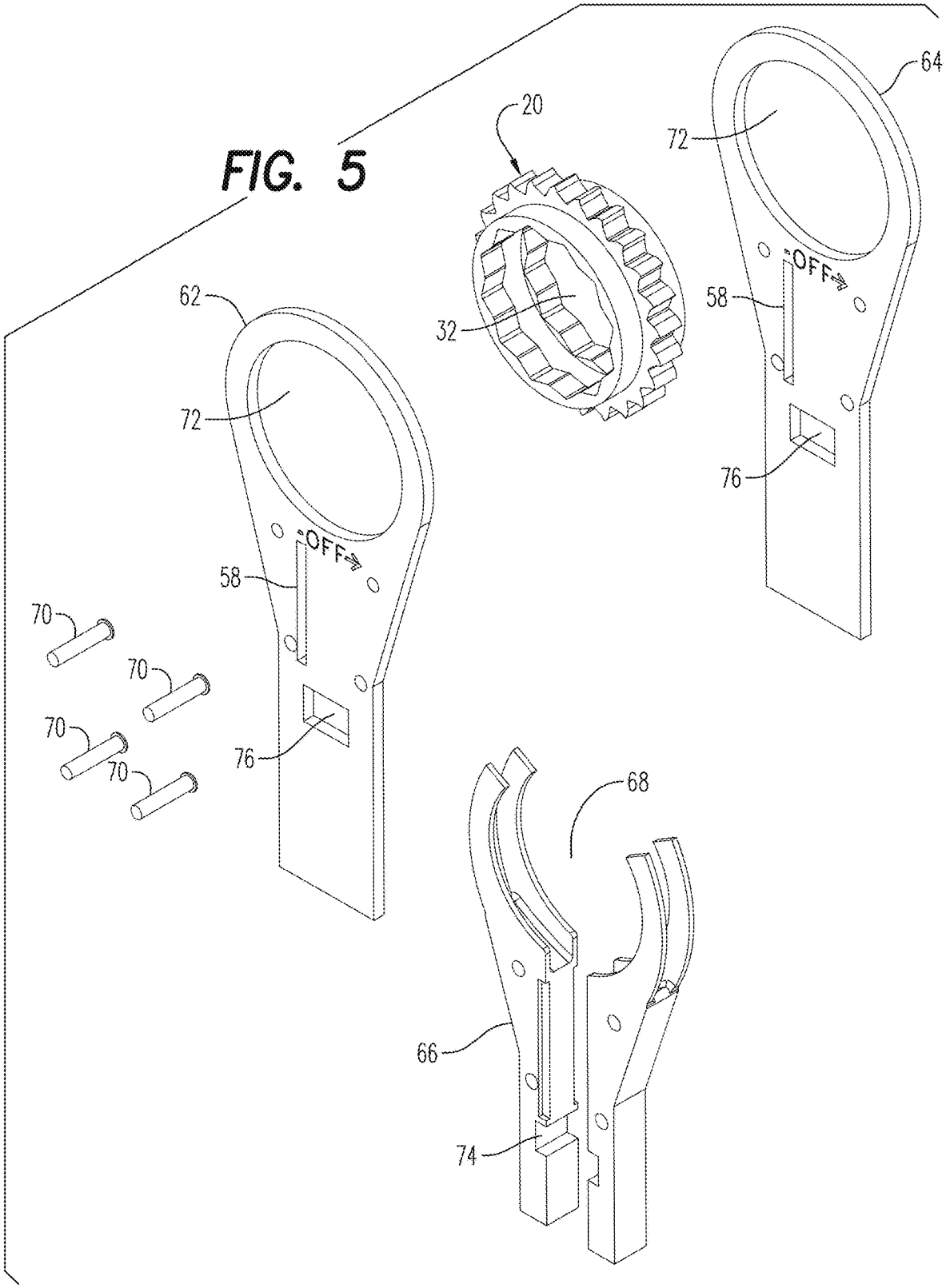
FIG. 5 is partial exploded view of the wrench of FIG. 1.
Figure 6:
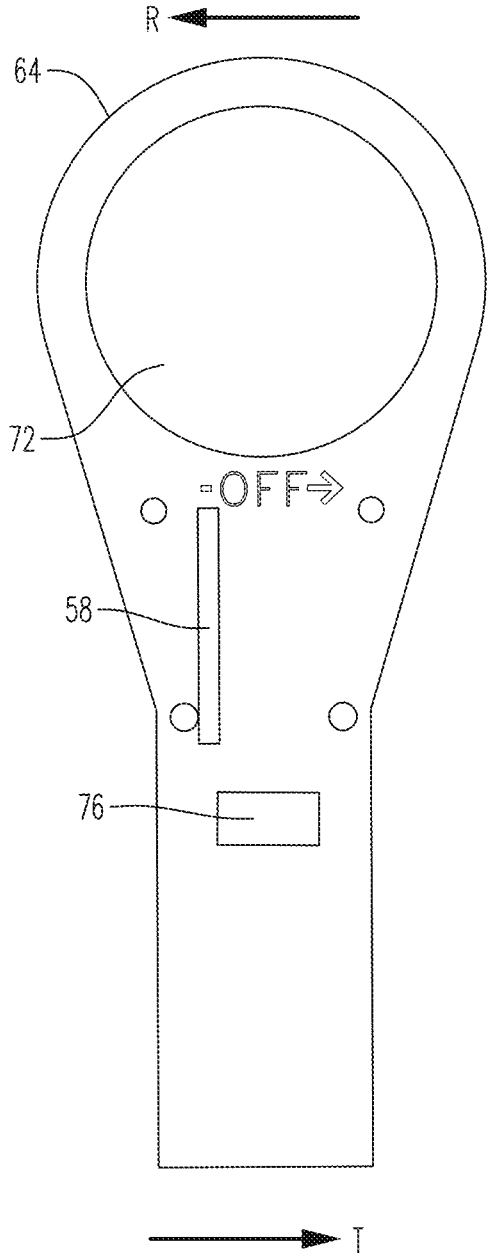
FIG. 6 is a side view of a first face plate according to the present disclosure usable in the wrench of FIG. 1.
Figure 7:
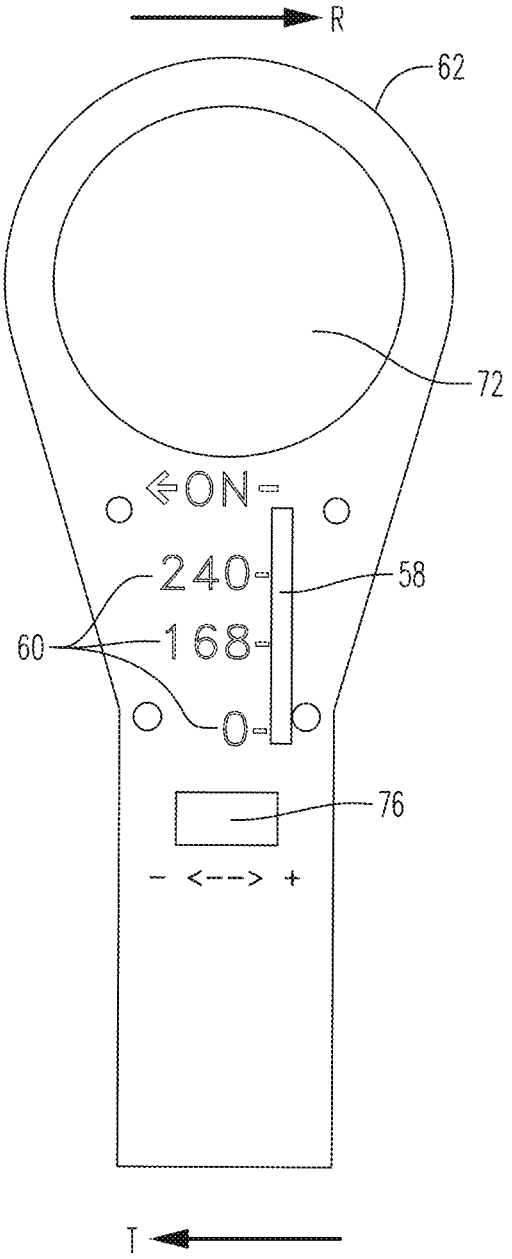
FIG. 7 is a side view of a first face plate according to the present disclosure usable in the wrench of FIG. 1.
Figure 8:
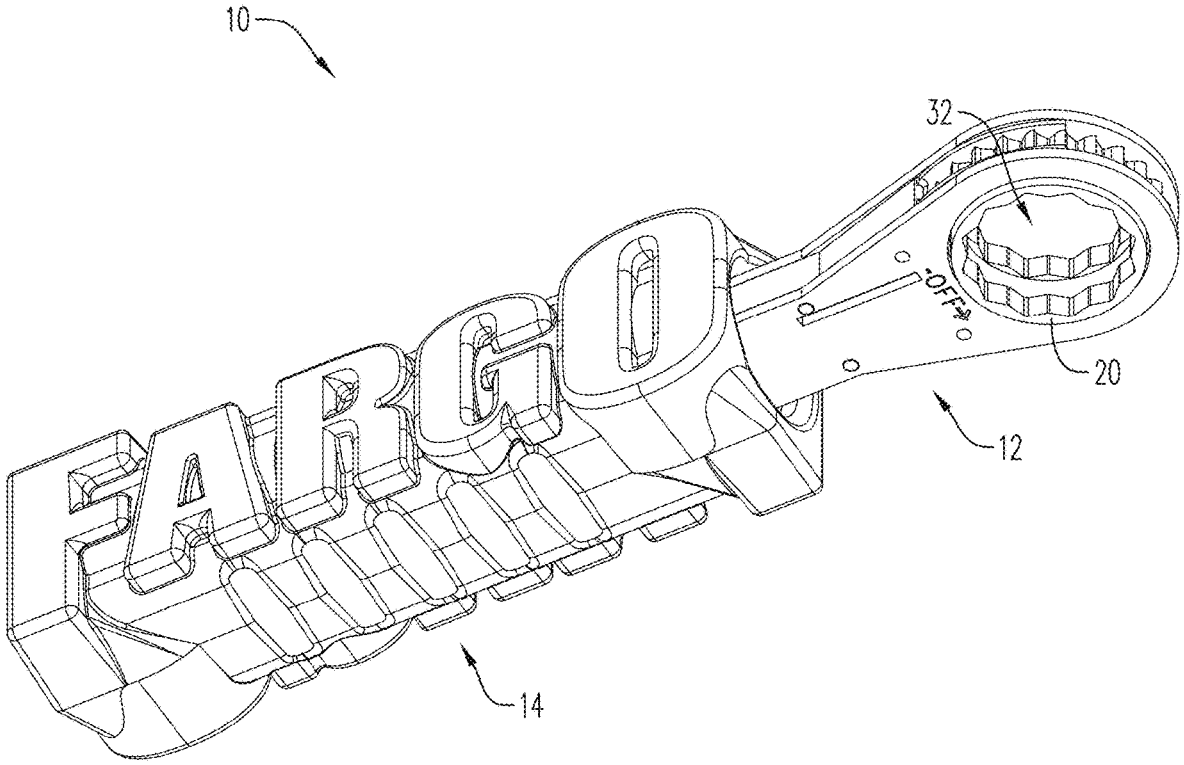
FIG. 8 is a perspective view of the ratcheting box torque wrench of FIG. 1 having an alternate exemplary embodiment of a torque adjusting assembly according to the present disclosure.
Figure 9:
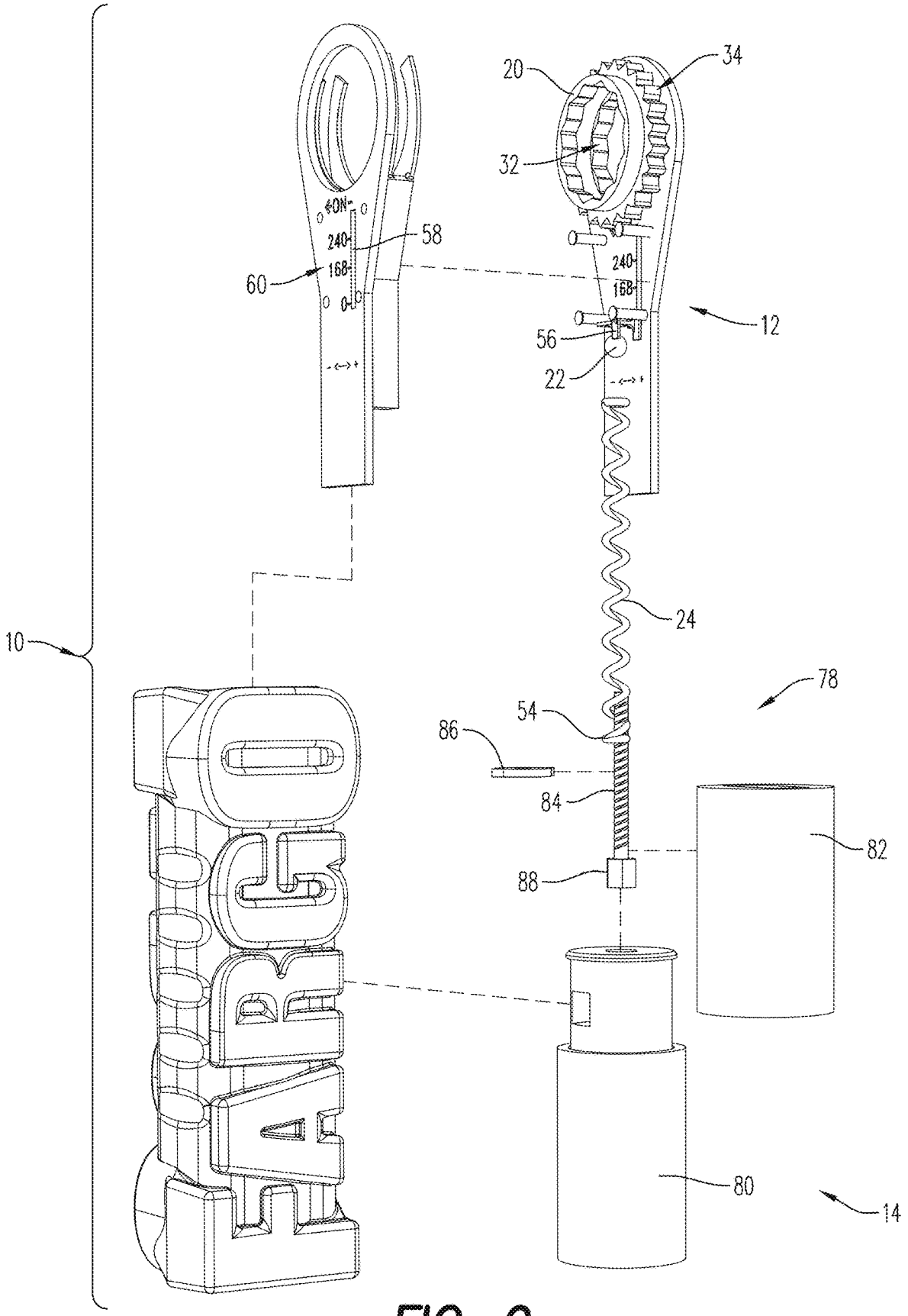
FIGS. 9-11 are partially exploded views of the wrench of FIG. 8 illustrating the torque adjusting assembly.
Figure 10:
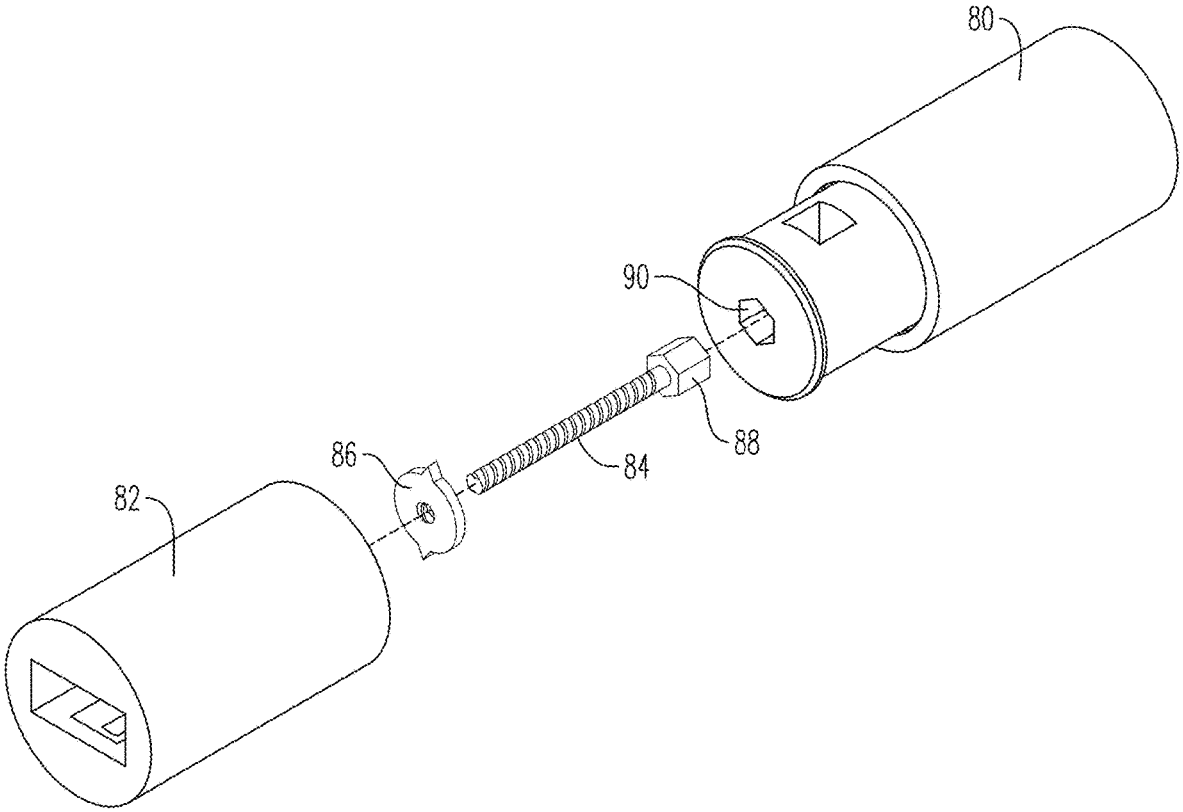
Figure 11:
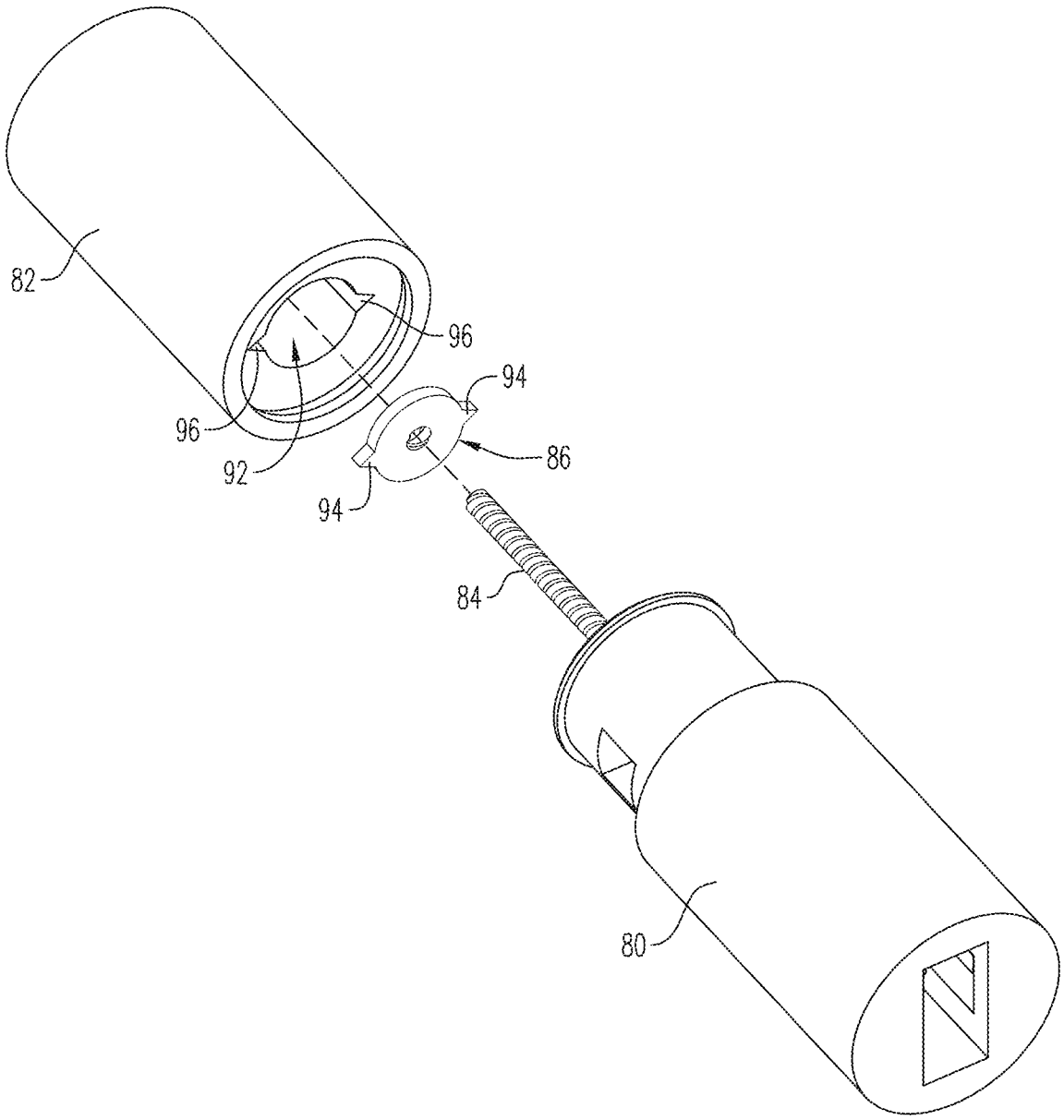

Head 12 includes a first face plate 62, a second face plate 64, and a spacer plate 66 shown in the exploded view of FIG. 5. Spacer plate 66 includes a central opening 68 configured to rotatably receive gear wheel 20. First and second face plates 62, 64 are secured on opposite sides of space plate 66 by one or more connectors 70, illustrated as rivets. Here, face plates 62, 64 each include an opening 72 that allows wrench 10 to be positioned over the fastener so that the fastener is mated by inner surface 32 of gear wheel 20.

In embodiments where wrench 10 includes torque adjusting assembly 28, spacer plate 66 can include a region 74 that receives worm gear 50 before assembly of the first and second face plates 62, 64. Further, first and second face plates 62, 64 include openings 76 through which worm gear 50 protrudes to allow adjustment of assembly 28.

Inner surface 32 is configured to apply torque to the fastener in a known manner. For example, inner surface 32 is shown as a twelve-point wrench that directly applies torque to an outer surface of the fastener. Of course, it is contemplated by the present disclosure for inner surface 32 to have desired configuration such as, but not limited to, a six-point wrench, a star-point wrench, a four-point wrench, and others.

Furthermore, it is contemplated by the present disclosure for inner surface 32 to be configured to apply torque in a known manner to the outer surface of an intermediate member (not shown) such as, but not limited to a socket, a driver bit, a hex bit, and others. Here, inner surface 32 applies torque to the outer surface of the intermediate member, which then applies torque to an inner or outer surface of the fastener.

It should be recognized that wrench 10 is described above by way of example as having torque adjusting assembly 28 illustrated being adjusted using worm gear 50. Of course, it is contemplated by the present disclosure for wrench 10 to have any desired torque adjusting assembly 28 configured to allow the user to set an amount of torque applied by wrench 10 in the first direction (T) before slipping.

For example, an alternate exemplary embodiment of a torque adjusting assembly 78 according to the present disclosure use shown in FIGS. 8-11.

Wrench 10 again includes head 12 and handle 14. Head 12 is a ratcheting box wrench that also functions as a torque limiting slip wrench. As discussed above, head 12 includes a gear wheel 20, a roller 22, and a coil spring 24 that together form a slipping torque limiter 26.

Head 12 can permanently fixed to handle 14 or can be a separate member that is removably attached to the handle. Again, handle 14 is an electrically non-conductive handle as disclosed in Applicant's own U.S. application Ser. No. 14/663,131, the contents of which are incorporated by reference herein. Further, although wrench 10 is shown as a single sided wrench, namely only having one head 12, it is contemplated by the present disclosure for the wrenches of the present disclosure to find equal use with two wrenches positioned in handle 14 (i.e., double ended wrench) as described in detail above.

In this embodiment torque adjusting assembly 78 allows the user to adjust the amount of torque by rotating head 12 and handle 14 with respect to one another about longitudinal axis (L). Assembly 78 includes a fixed portion 80 and a rotational portion 82 within handle 14. Fixed portion 80 is fixedly secured to handle 14, while rotational portion 82 is secured to the fixed portion for rotation about the axis (L). Head 12 is secured—permanently or removably—to rotational portion 12 so that a user can rotate head 12 and rotational portion 82 about the axis (L) with respect to fixed portion 80.

Assembly 78 further includes a drive rod 84 and a drive plate 86, where the drive plate is threadably received on an outer surface of the drive rod so that rotation of head 12 and handle 14 with respect to one another threadably moves the drive plate along axis (L).

Drive plate 86 supports a spring end 54 of spring 24 opposite from roller 22. Thus, movement of drive plate 86 along axis (L) towards roller 22 compresses spring 24 between the roller and the plate, resulting in an increase in holding force (F)—and a corresponding increase in the torque that wrench 10 applies to the fastener in first direction (T). Conversely, movement of drive plate 86 along axis (L) away from roller 22 allows spring 24 to decompress or elongate, resulting in a decrease in holding force (F)—and a corresponding decrease in the torque that wrench 10 applies to the fastener in first direction (T).

Drive rod 84 is secured to fixed portion 80 so that the rod does not rotate about axis (L) within the fixed portion. In the illustrated embodiment, drive rod 84 has a first end 88 positioned in a corresponding opening 90 of fixed portion 80, where the end and opening are configured to prevent rotation between the drive rod and the fixed portion.

Drive plate 86 is positioned in an opening 92 of rotational portion 82 so that the plate does not rotate about axis (L) within the rotational portion, but so that the plate moves along the axis within the rotational portion. In the illustrated embodiment, drive plate 86 has one or more features 94, illustrated as protrusions, that mate with corresponding features 96 of opening 92.

During adjustment, the user rotates head 12 and handle 14 about axis (L) with respect to one another, which rotates drive rod 84 with respect to drive plate 86 so that the drive plate moves along the thread of the drive rod along the axis (L).

In some embodiments, assembly 78 can include an indicator 56 depending operatively associated with drive plate 86 so that compression/elongation of spring 24 along axis (L) provides corresponding movement of the indicator. Assembly 28 includes a window 58 in one or more portions of head 12, which allow indicator 56 to be visible to the user. Here, head 12 can include one or more markings 60 of the position of indicator 56 seen through window 58, where the markings correspond to the torque limit of slipping torque limiter 26.

Advantageously, wrench 10 provides a simple structure that uses the same elements, namely gear 20, roller 22, and spring 24, that provide the ratcheting functionality to also provide a torque limiting functionality. Moreover, wrench 10 via assembly 28 or 78 allows the user to easy adjust toe torque limit of the wrench.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

PARTS LIST

| |
|---|
| ratcheting box torque wrench 10 |
| head 12 |
| handle 14 |
| gear wheel 20 |
| roller 22 |
| coil spring 24 |
| slipping torque limiter 26 |
| first direction (T) |
| second direction (R) |
| torque adjusting assembly 28 |
| inner surface 32 |
| outer surface 34 |
| teeth 36 |
| space 38 |
| leading edge 40 |
| trailing edge 42 |
| stepped profile 44 |
| un-stepped profile 46 |
| holding force (F) |
| spring end 48 |
| worm gear 50 |
| spring cartridge 52 |
| longitudinal axis (L) |
| spring end 54 |
| indicator 56 |
| window 58 |
| markings 60 |
| first face plate 62 |
| second face plate 64 |
| spacer plate 66 |
| central opening 68 |
| connectors 70 |
| opening 72 |
| region 74 |
| openings 76 |
| torque adjusting assembly 78 |
| fixed portion 80 |
| rotational portion 82 |
| drive rod 84 |
| drive plate 86 |
| first end 88 |
| opening 90 |
| opening 92 |
| features 94 |
| features 96 |

What is claimed is:

1. A ratcheting box torque wrench, comprising:

a head having a slipping torque limiter, the slipping torque limiter applying torque to a fastener in a first direction (T) up to a torque limit before slipping in the first direction (T) and ratcheting in a second direction (R); and handle depending from the head, wherein the head includes a first face plate, a second face plate, and a spacer plate, the spacer plate has includes a central opening configured to rotatably receive the slipping torque limiter therein, the first and second face plates being secured on opposite sides of the spacer plate to secure the slipping torque limiter therein, wherein the slipping torque limiter comprises a gear wheel, a single roller, and a single coil spring, the gear wheel comprising an inner surface and an outer surface, the inner surface being configured to directly apply torque to the fastener with a configuration selected from a group consisting of a twelve-point wrench, a six-point wrench, a star-point wrench, and a four-point wrench, the outer surface comprising a plurality of teeth having a space between adjacent teeth, the single coil spring being in direct contact with the single roller and biasing the single roller into the space of a respective one of the plurality of teeth with a holding force (F).

2. The wrench of claim 1, wherein each tooth of the plurality of teeth comprises a leading edge facing the first direction and a trailing edge facing the second direction, wherein the leading edge has a stepped profile that has a slope that changes towards the first direction, and wherein the leading and trailing edges meet at point.

3. The wrench of claim 2, wherein the trailing edge comprises an un-stepped profile.

4. The wrench of claim 3, wherein, when torque applied in the first direction (T) is below the holding force (F), the single coil spring maintains the single roller in the space allowing the inner surface of the gear wheel to transmit torque.

5. The wrench of claim 3, wherein, when torque applied in the first direction (T) is above the holding force (F), the single coil spring compresses so that the single roller slips from the space over the stepped profile allowing the gear wheel to rotate without transmitting torque.

6. The wrench of claim 3, wherein, when torque is applied in the second direction (R), the single coil spring compresses as the single roller slips from the space over the un-stepped profile allowing the gear wheel to ratchet.

7. The wrench of claim 1, wherein the head is fixed to the handle or is removably attached to the handle.

8. The wrench of claim 1, wherein the head lacks any hinge.

9. The wrench of claim 1, wherein the handle is an electrically non-conductive handle.

10. The wrench of claim 1, wherein the slipping torque limiter comprises a single, predetermined or factory set torque limit.

11. The wrench of claim 1, wherein the slipping torque limiter comprises a torque adjusting assembly that allows adjustment of the torque limit.

12. The wrench of claim 11, wherein the torque adjusting assembly adjusts the holding force (F) that the single coil spring biases the single roller into the space.

13. The wrench of claim 11, wherein the torque adjusting assembly comprises a worm gear threadably received over a spring cartridge, the single coil spring being supported in the spring cartridge at an end opposite the single roller, wherein rotation of the worm gear is translated into linear movement along a longitudinal axis (L) towards the single roller so as to compress the single coil spring resulting in an increase in the holding force (F) or away from the single roller so as to elongate the single coil spring resulting in a decrease in the holding force (F).

14. The wrench of claim 13, wherein the torque adjusting assembly further comprises an indicator depending from the spring cartridge, wherein movement of the spring cartridge provides corresponding movement of the indicator to one or more markings corresponding to the torque limit.

15. The wrench of claim 11, wherein the torque adjusting assembly adjusts the holding force (F) that the single coil spring biases the single roller into the space by rotation of the head and the handle with respect to one another about a longitudinal axis (L).

16. The wrench of claim 1, wherein the gear wheel is rotatably received in the central opening of the spacer plate.

17. The wrench of claim 1, wherein the head is a solid, straight member.

18. A ratcheting box torque wrench, comprising:

a handle; and a head depending from the handle, the head comprising a first face plate, a second face plate, a spacer plate, and a slipping torque limiter, wherein the slipping torque limiter comprises a gear wheel, a single roller, and a single coil spring, wherein the gear wheel comprises an inner surface and an outer surface, the outer surface having a plurality of teeth having a space between adjacent teeth, the inner surface being configured to apply torque to a fastener, wherein the first and second face plates are secured on opposite sides of the spacer plate to secure the slipping torque limiter therebetween such that the single coil spring is in direct contact with the single roller and biases the single roller into the space of a respective one of the plurality of teeth with a holding force (F) and such that the inner surface of the gear wheel is mateable with a fastener through openings in the first and second face plates, respectively, and wherein the outer surface is configured so that the slipping torque limiter applies torque to the fastener in a first direction (T) up to a torque limit before overcoming the holding force (F) and slipping in the first direction (T) and is configured to ratchet in a second direction (R).

19. The wrench of claim 18, wherein the inner surface is configured to directly apply torque to the fastener.

20. The wrench of claim 18, further comprising a torque adjusting assembly that allows adjustment of the torque limit by rotation of the handle with respect to the head.

21. The wrench of claim 20, wherein the torque adjusting assembly comprises:

a first portion fixed in the handle against rotation with respect to the handle;

a second portion rotatable within the handle and rotatably secured to the first portion, the head being fixed in the second portion against rotation with respect to the second portion;

a drive rod secured in the first portion against rotation with respect to the first portion, the drive rod extending through the second portion and into the single coil spring; and a drive plate threadably received on an outer surface of a drive rod, the drive rod passing through the second portion with the drive plate slidably received in the second portion, but being fixed in the second portion against rotation with respect to the second portion, the drive plate supporting an end of the single coil spring opposite from the single roller, wherein rotation of the handle with respect to the head moves the drive plate along the drive rod to increase or decrease the holding force (F) by compressing or decompressing the single spring.

22. The wrench of claim 21, wherein the torque adjusting assembly further comprises an indicator operatively associated with drive plate so that compression/elongation of the single coil spring provides corresponding movement of the indicator.

* * * * *